US007621693B2

(12) United States Patent
McDonald

(10) Patent No.: US 7,621,693 B2
(45) Date of Patent: Nov. 24, 2009

(54) ASPHALT FIBER PANELS FOR PAVEMENT CONSTRUCTION AND REPAIR

(76) Inventor: Charles Sanfield McDonald, 2453 NE. 15th Ave., Payette, ID (US) 83661

( * ) Notice: Subject to any disclaimer, the term of this patent is extended or adjusted under 35 U.S.C. 154(b) by 96 days.

(21) Appl. No.: 11/983,249

(22) Filed: Nov. 7, 2007

(65) Prior Publication Data

US 2009/0116905 A1 May 7, 2009

(51) Int. Cl.
*E01C 3/06* (2006.01)

(52) U.S. Cl. ..... 404/17; 404/31; 404/72; 404/75; 404/76; 404/82; 442/381

(58) Field of Classification Search ..... 404/72, 404/17, 71, 45, 18, 29, 31, 34–36, 44, 75, 404/82, 76

See application file for complete search history.

(56) References Cited

U.S. PATENT DOCUMENTS 4,362,780 A * 12/1982 Marzocchi et al. ..... 442/85
4,617,219 A * 10/1986 Schupack ..... 428/113
4,793,731 A * 12/1988 Gnesa ..... 404/83
4,834,577 A * 5/1989 Perfetti ..... 404/82
4,885,659 A * 12/1989 Nowell et al. ..... 361/212
4,996,095 A * 2/1991 Behdorf et al. ..... 428/215
5,174,228 A * 12/1992 Grimnes ..... 112/475.01
5,226,210 A * 7/1993 Koskenmaki et al. ..... 29/527.5
5,246,306 A * 9/1993 Shoesmith et al. ..... 404/70
5,411,352 A * 5/1995 Eren ..... 404/31
5,836,715 A * 11/1998 Hendrix et al. ..... 404/134
5,869,413 A * 2/1999 Gallagher et al. ..... 442/381
6,013,376 A * 1/2000 Yenni, Jr. ..... 428/458
6,123,879 A * 9/2000 Hendrix et al. ..... 264/31
6,450,729 B1 * 9/2002 Clapp ..... 404/75
7,168,887 B1 * 1/2007 Rossi ..... 404/75
7,232,276 B2 * 6/2007 Oka et al. ..... 404/31

* cited by examiner

*Primary Examiner*—Raymond W Addie

(57) ABSTRACT

The repair of pavement is performed by placing rigid waterproof asphalt fiber panels over the existing pavement before placing the asphalt concrete overlay on the pavement. The panels are cemented in place with liquid asphalt to the existing worn pavement and to the new asphalt concrete overlay; also the asphalt panels are similarly used in the construction of new pavement wherein the panels are placed between the two layers of the new asphalt concrete or between the asphalt concrete and the rock leveling course.

2 Claims, 2 Drawing Sheets

ASPHALT FIBER PANELS FOR PAVEMENT CONSTRUCTION AND REPAIR

1 New Pavement surface

2 New Asphalt Concrete overlay cross section

3 New Asphalt Fiber Panels cross section

4 Existing cracked layer of old pavement cross section

5 Existing crushed rock leveling course cross section

6 Existing base rock course cross section

ASPHALT FIBER PANELS FOR PAVEMENT CONSTRUCTION AND REPAIR

1 New Pavement surface

2 New Asphalt Concrete overlay cross section

3 New Asphalt Fiber Panels cross section

4 Existing cracked layer of old pavement cross section

5 Existing crushed rock leveling course cross section

6 Existing base rock course cross section

ASPHALT FIBER PANELS
FOR PAVEMENT CONSTRUCTION AND REPAIR

1 New Pavement surface

2 New Asphalt Concrete surface course cross section

3 New Asphalt Fiber Panels cross section

4 New Asphalt Concrete leveling course cross section

5 New crushed rock leveling course cross section

6 New base rock cross section

ASPHALT FIBER PANELS FOR PAVEMENT CONSTRUCTION AND REPAIR

BACKGROUND OF THE INVENTION

1. Field of the Invention

In street and highway maintenance when a pavement is generally well aged and worn with roughness and cracks, the practice is usually to resurface it with a layer of asphalt concrete to extend the life of the existing pavement rather than to dig out all of the existing pavement and completely rebuild the total structure, except in extreme cases where the condition of the pavement is so poor that it is necessary to remove the whole existing pavement and reconstruct a total new pavement The invention is a sheet of asphalt impregnated cotton fiber placed in the upper structural section of either 1) local, 2) highway, 3) freeway roadway pavement or 4) parking lots immediately beneath the new layer of asphalt concrete to strengthen and waterproof the pavement with a membrane 99.9% impervious to water and prevent reflection cracking through the new top layer of asphalt for ten years and longer.

2. Description of the Prior Art

Various forms of proprietary so-called stress relieving interlayers have been tried by numerous street and highway departments with limited success because the cracks from the old pavement reflected through to the new surface of the asphalt concrete overlay as early as 6 months after placement on the old pavement. Furthermore, the waterproof characteristics of the pavement are not improved in most cases because the membranes do not limit the passage of water into the rock leveling and base courses of the pavement which weakens the whole pavement structure.

SUMMARY OF THE INVENTION

In the process of maintaining an existing roadway the invention is placed between the existing pavement surface and the bottom of the new asphalt concrete surfacing which performs the function of preventing the cracks in the old pavement surface from reflecting through the new asphalt concrete surface and allowing water to penetrate the whole pavement, causing it to deteriorate. This action significantly extends the life of the pavement, improves the rideability and reduces the long term cost of roadway maintenance.

DESCRIPTION OF THE PREFERRED EMBODIMENT

Figure 1:
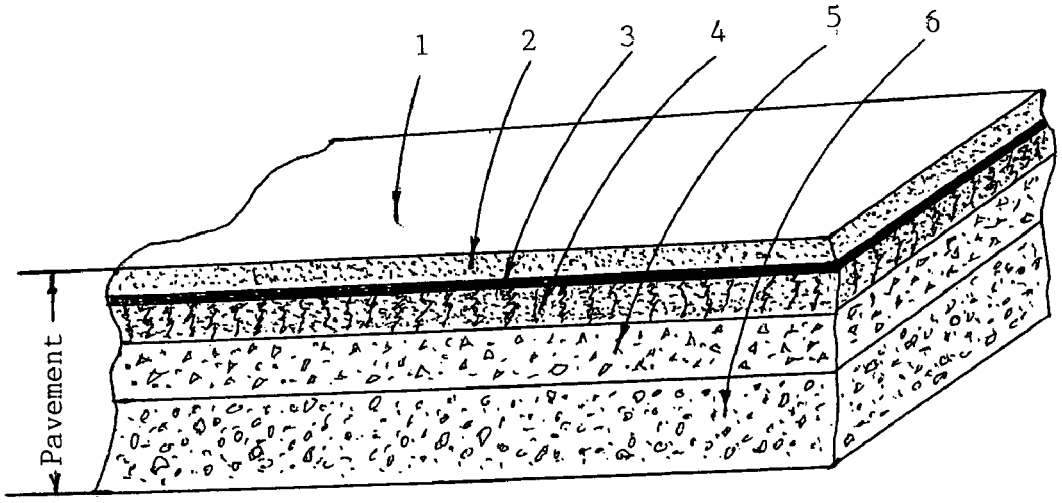
FIG. 1 is a cross section view of a pavement showing the embodiment of the asphalt paneling in its proper position directly above the existing cracked asphalt concrete and below the new asphalt concrete overlay.
Figure 2:
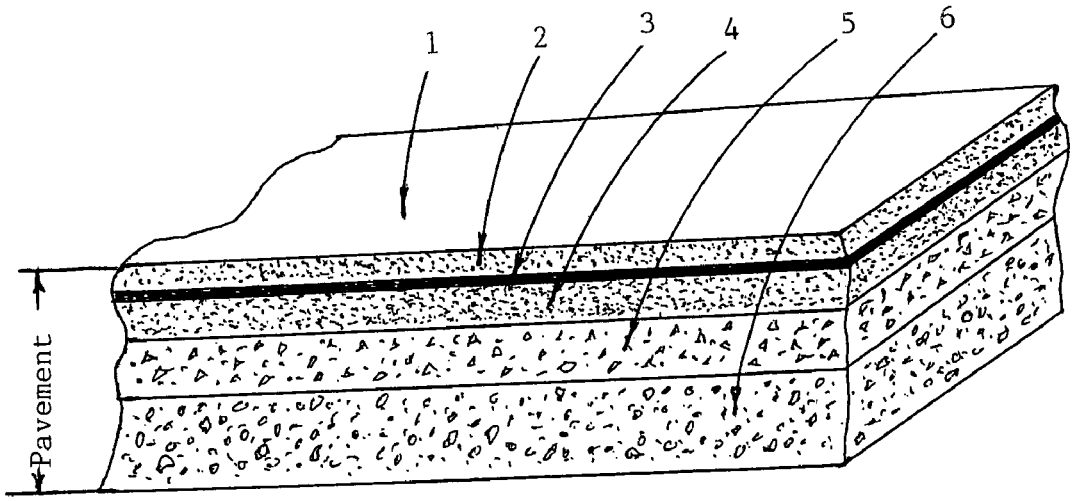
FIG. 2 is a cross section view of a newly constructed pavement showing the embodiment of the asphalt paneling in its proper place between the two courses of the new asphalt concrete.

The Asphalt Panels consist of cotton or other fiber impregnated with asphalt to produce panels of thicknesses varying from ⅛th inch to ½ inch and larger. The panels are typically furnished in sheets having dimensions of 4 feet by 10 feet, have a high shear strength to resist deflection, they are 99.9% waterproof and dimensions can be varied. Wherein the diameter of the fibers and the thickness of the asphalt impregnating the fibers can be varied to produce the panels in thickness of approximately ⅛" to ½" and more. The thickness of the impregnation layer increases/decreases the deflection and vibration dampening characteristics of the panel.

The improvement comprises the placement of the asphalt panels on the existing roadway after it is swept clean of any loose material and a tack coat of liquid asphalt is placed on the existing roadway. The panels are placed using butt joints or lapped joints according to the judgment of the Engineer in charge of the project and are rolled by a power machine sufficiently to eliminate any air bubbles between the tack coat and the panels. A tack coat of liquid asphalt is then applied to the top of the panels, the overlay of asphalt concrete is then applied and rolled to smooth and compact the overlay. After the normal cooling period of the overlay the roadway is opened to traffic

The invention claimed is:

1. An asphalt and fiber roadway panel consisting of:

Upper and lower layers of fiber material forming upper and lower surfaces capable of bonding to tack coats, and receiving new asphalt overlays;

An asphaltic impregnating layer disposed between and through the fiber layers,

Wherein the diameter of the fibers and the thickness of the asphalt layer can be varied to form sheets that provide high shear strength and water barrier between pavement and sub-grade layers.

2. The asphalt and fiber roadway panel of claim 1, wherein the fiber layers can be cotton, fiberglass or similar fiber fabrics, woven or unwoven mesh.

* * * * *